US007585020B1

(12) United States Patent
Wahl, Jr.

(10) Patent No.: US 7,585,020 B1
(45) Date of Patent: Sep. 8, 2009

(54) SUNSHADE APPARATUS

(76) Inventor: Eugene Wahl, Jr., 27072 W. Mill Pond Rd., Dana Point, CA (US) 92624

( * ) Notice: Subject to any disclaimer, the term of this patent is extended or adjusted under 35 U.S.C. 154(b) by 0 days.

(21) Appl. No.: 12/181,984

(22) Filed: Jul. 29, 2008

Related U.S. Application Data

(63) Continuation-in-part of application No. 11/825,171, filed on Jul. 5, 2007, now abandoned.

(51) Int. Cl.
*A47C 7/62* (2006.01)

(52) U.S. Cl. ..... 297/184.15

(58) Field of Classification Search ..... 297/184.15, 297/184.1; 24/334; 135/96, 143, 121, 139, 135/142; 248/316.5, 229.14, 229.13
See application file for complete search history.

(56) References Cited

U.S. PATENT DOCUMENTS

| | | | | |
|---|---|---|---|---|
| 405,038 | A | | 6/1889 | Koechling |
| 510,468 | A | * | 12/1893 | Buehl ..... 248/214 |
| 840,241 | A | | 1/1907 | Nootbaar |
| 923,596 | A | | 6/1909 | Staples |
| 1,480,286 | A | | 1/1924 | Morganstern |
| 2,660,186 | A | | 11/1953 | Marshall et al. |
| 3,289,982 | A | | 12/1966 | Hart, Jr. |
| 3,434,483 | A | | 3/1969 | Topham |
| 3,533,590 | A | | 10/1970 | Swire |
| 3,904,161 | A | | 9/1975 | Scott |
| 4,063,318 | A | | 12/1977 | Nicholson |
| 4,225,104 | A | | 9/1980 | Larson |
| 4,295,481 | A | | 10/1981 | Gee |
| D265,862 | S | | 8/1982 | Caldwell |
| 4,375,901 | A | | 3/1983 | MacDonald |
| 4,736,921 | A | | 4/1988 | Zane et al. |
| 4,809,724 | A | | 3/1989 | Fuser |
| 4,865,381 | A | | 9/1989 | Van Rogue |
| 5,000,210 | A | | 3/1991 | Worthington, Jr. |
| 5,022,420 | A | | 6/1991 | Brim |
| 5,096,257 | A | | 3/1992 | Clark |
| 5,168,889 | A | | 12/1992 | Diestel |
| 5,203,363 | A | | 4/1993 | Kidwell et al. |
| 5,240,020 | A | | 8/1993 | Byers |
| 5,344,115 | A | | 9/1994 | Mayne et al. |
| 5,441,067 | A | | 8/1995 | James et al. |
| 5,622,345 | A | | 4/1997 | Hopkins |
| 5,797,650 | A | | 8/1998 | Gonzales, Jr. et al. |
| 5,836,327 | A | | 11/1998 | Davis |
| 5,918,613 | A | | 7/1999 | Larson |
| 5,967,601 | A | | 10/1999 | Gillins |
| 6,349,666 | B1 | | 2/2002 | Hatsings |
| 6,371,553 | B1 | | 4/2002 | Tang |
| 6,375,146 | B1 | | 4/2002 | Painchaud |
| 6,588,966 | B2 | | 7/2003 | Kane et al. |
| 6,789,557 | B1 | | 9/2004 | Wahl, Jr. |
| 2002/0125388 | A1 | | 9/2002 | Eslick |

* cited by examiner

*Primary Examiner*—Milton Nelson, Jr.
(74) *Attorney, Agent, or Firm*—Eric Karich

(57) ABSTRACT

A sunshade apparatus for shading a chair has a flexible canopy element, and a support structure for supporting the flexible canopy element above the chair. A pair of attachment elements is attached to a bottom ends of a pair of vertical support legs of the support structure. Each of the attachment elements includes a pair of clamp elements that each include a clamping end opposite a lever end, the clamping ends of the pair of clamp elements together being shaped to engage the chair. A hinge connects the clamp elements, and a spring biases them towards a closed position.

1 Claim, 4 Drawing Sheets

48
42
64
40
44
60
62
68
66
22
50
20
40
46
6
50
52
10
20
26
24
4
26
14
12

SUNSHADE APPARATUS

CROSS-REFERENCE TO RELATED APPLICATIONS

This application for a utility patent is a continuation-in-part of a previously filed utility patent Ser. No. 11/825,171, filed Jul. 5, 2007, which is still pending, which claimed priority to previously filed application Ser. No. 11/491,723, filed Jul. 24, 2006, now U.S. Pat. No. 7,243,990.

STATEMENT REGARDING FEDERALLY SPONSORED RESEARCH

Not Applicable

BACKGROUND OF THE INVENTION

1. Field of the Invention

This invention relates generally to sun shades, and more particularly to a sunshade apparatus that is easily portable and can be quickly and easily yet securely attached to a portable chair.

2. Description of Related Art

Wahl, Jr., U.S. Pat. No. 6,789,557, teaches a portable and collapsible sunshade apparatus having a universal attachment clip. The universal attachment clip enables any type of sunshade apparatus to be attached to any type of beach chair or lounge chair at any desired height above the occupant of the chair and at any desired angular orientation relative to the chair. The universal attachment clip includes clamshell jaws that are moved between open and closed positions via a screw-type threaded bolt.

Gillins, U.S. Pat. No. 5,967,601, teaches a sunshade apparatus for use with recreational chairs having a seat back. The sunshade has a rigid support to which upper edge clips and side edge clips are connected for releasable attachment to the seat back upper edge and seat back side edge, respectively. The side edge clips can rotate about the support in a generally horizontal plane, and the side edge clips are constructed in a manner to flex in a generally vertical plane. The upper edge clips have a hook portion to enable the sunshade to hang on the seat back upper edge. A canopy frame, covered with a shade producing cover, is pivotally attached to the support. When not in use, the canopy frame can be pivoted to a collapsed, generally flat configuration with the support.

Brim, U.S. Pat. No. 5,022,420, teaches a shade apparatus for use with a lawn mower. The apparatus includes a plurality of spaced U-shaped mounds for securement to handles of the lawnmower. Support rods pivotally mount at each respective end thereof with first canopy rods wherein the first canopy rods movably receive U-shaped canopy sliders wherein the organization is formable into a conveniently stored organization and easily errected and secured to the associated lawn mower. Further, the invention includes a storage container secured to the canopy wherein the storage container provides a tethered pair of ear protective devices for use in association with a lawn mower.

The above-described references are hereby incorporated by reference in full.

The prior art teaches various forms of sunshades that can be attached to a chair or other structure. However, the prior art does not teach a sunshade apparatus that includes attachment elements that enables the sunshade apparatus to be quickly and easily yet securely attached to a portable chair. The present invention fulfills these needs and provides further related advantages as described in the following summary.

SUMMARY OF THE INVENTION

The present invention teaches certain benefits in construction and use which give rise to the objectives described below.

The present invention provides a sunshade a sunshade apparatus for shading a chair. The sunshade apparatus includes a flexible canopy element, and a support structure for supporting the flexible canopy element above the chair. The support structure has a pair of vertical support legs each having a bottom end. A pair of attachment elements is attached to the bottom ends of the pair of vertical support legs. Each of the attachment elements includes a pair of clamp elements that each include a clamping end opposite a lever end, the clamping ends of the pair of clamp elements together being shaped to clamp the chair; a hinge connecting the pair of clamp elements such that the pair of clamp elements may pivot between an open position wherein the clamping ends are spread apart for receiving the chair, and a closed position wherein the clamping ends are closed against the chair; a spring for biasing the clamping ends of the clamp elements towards the closed position; and wherein the lever ends extend outwardly from the clamp elements such that they may be squeezed together to overcome the bias of the spring and move the clamp elements towards the open position thereby enabling the clamp elements to be removed from the chair.

A primary objective of the present invention is to provide a sunshade apparatus having advantages not taught by the prior art.

Another objective is to provide a sunshade apparatus that includes attachment elements that enable the sunshade apparatus to be quickly and easily yet securely attached to any form of chair for shading the chair.

Another objective is to provide a sunshade apparatus that can be easily adjusted to users of different heights.

A further objective is to provide a sunshade apparatus that is easy to unfold and attach to the chair for use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a sunshade apparatus 10 for shading a chair 12. While the chair 12 is illustrated as a standard portable chair, the term chair is hereby defined to include any form of chair, lounge, wheelchair, or other device upon which a person might sit, recline, or lounge.

Figure 1:
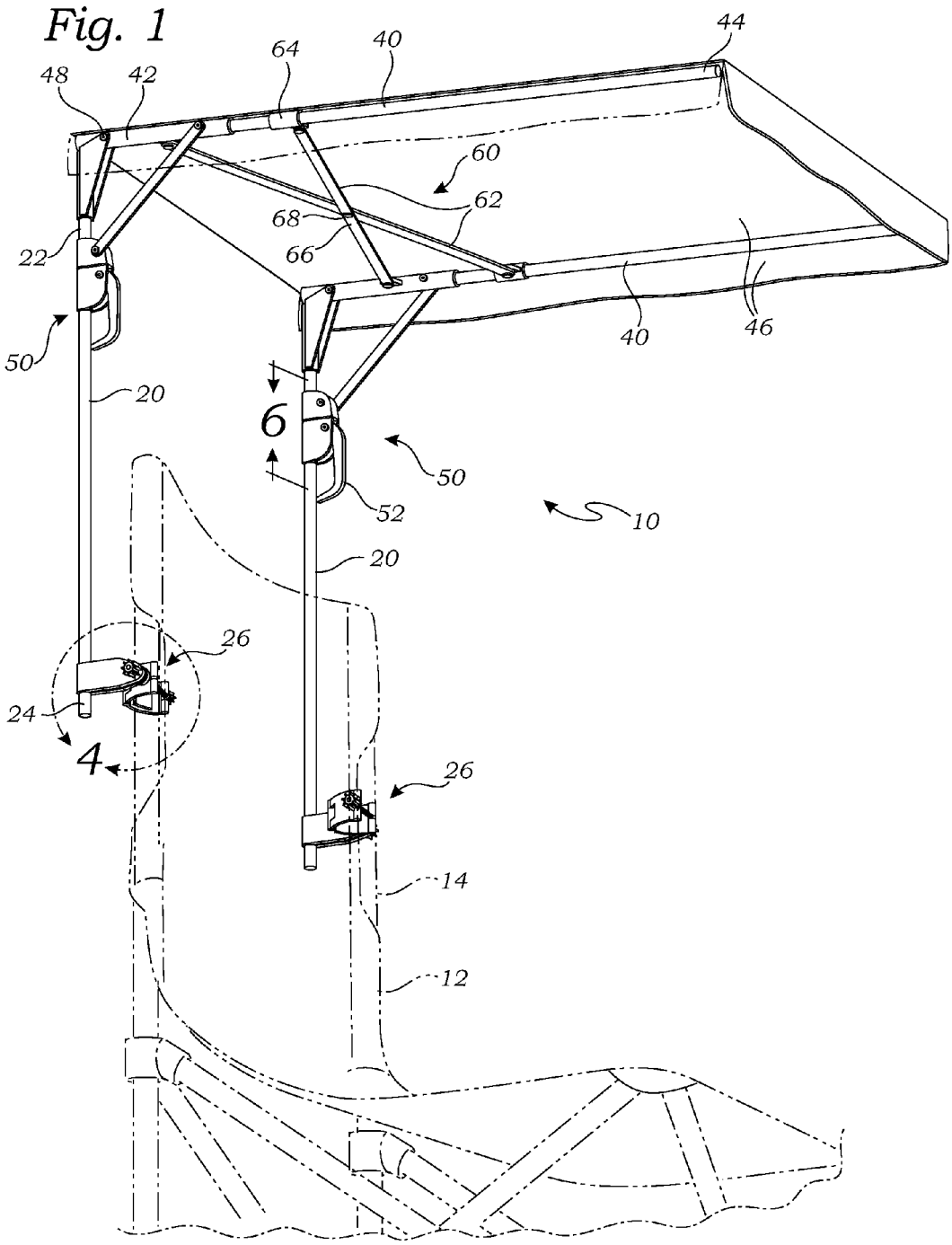
FIG. 1 is an exploded perspective view of a sunshade apparatus according to one embodiment of the present invention, illustrating the sunshade apparatus in an extended and spread configuration, and mounted on a chair.
Figure 2:
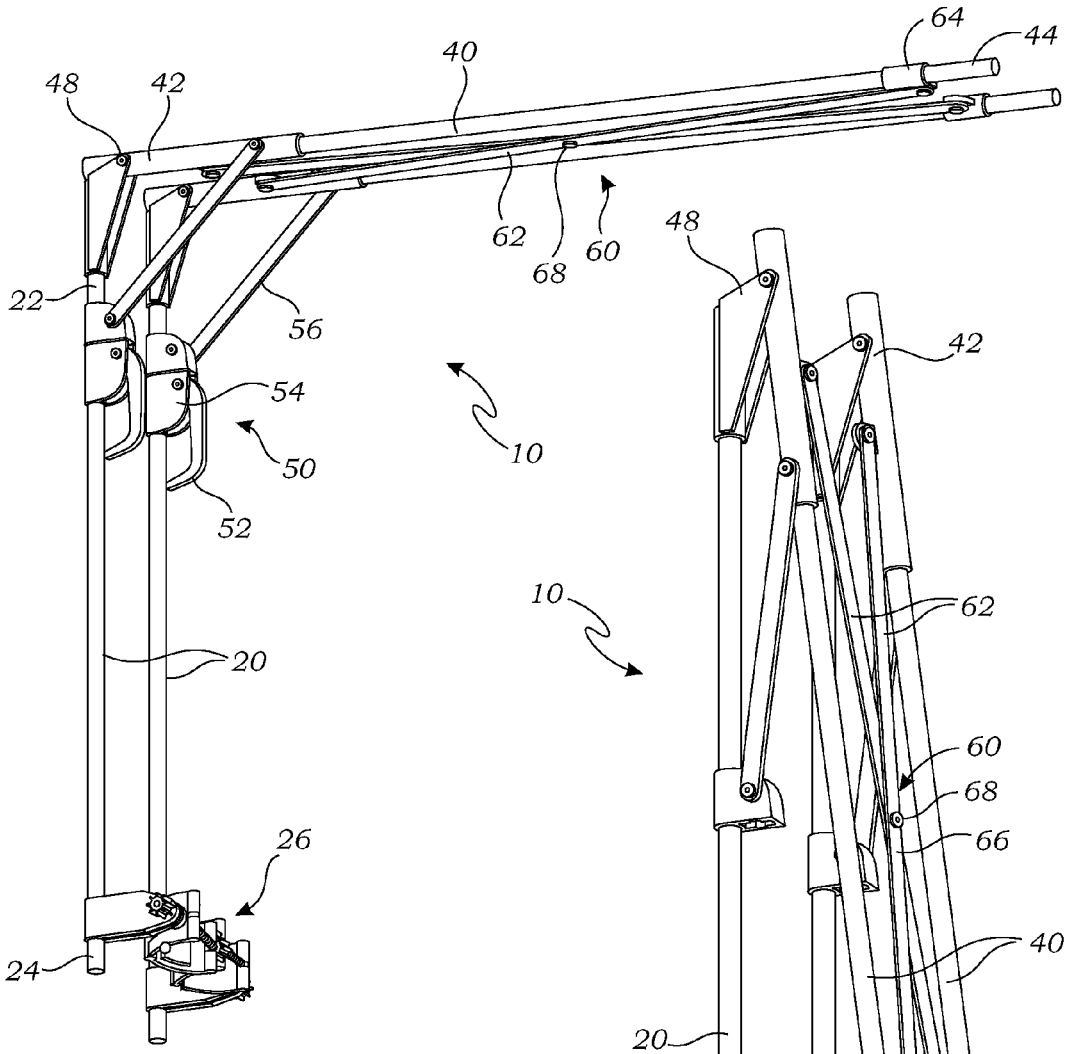
FIG. 2 is a perspective view of the sunshade apparatus of FIG. 1 once the sunshade apparatus has been moved from the spread configuration to a collapsed configuration.
Figure 3:
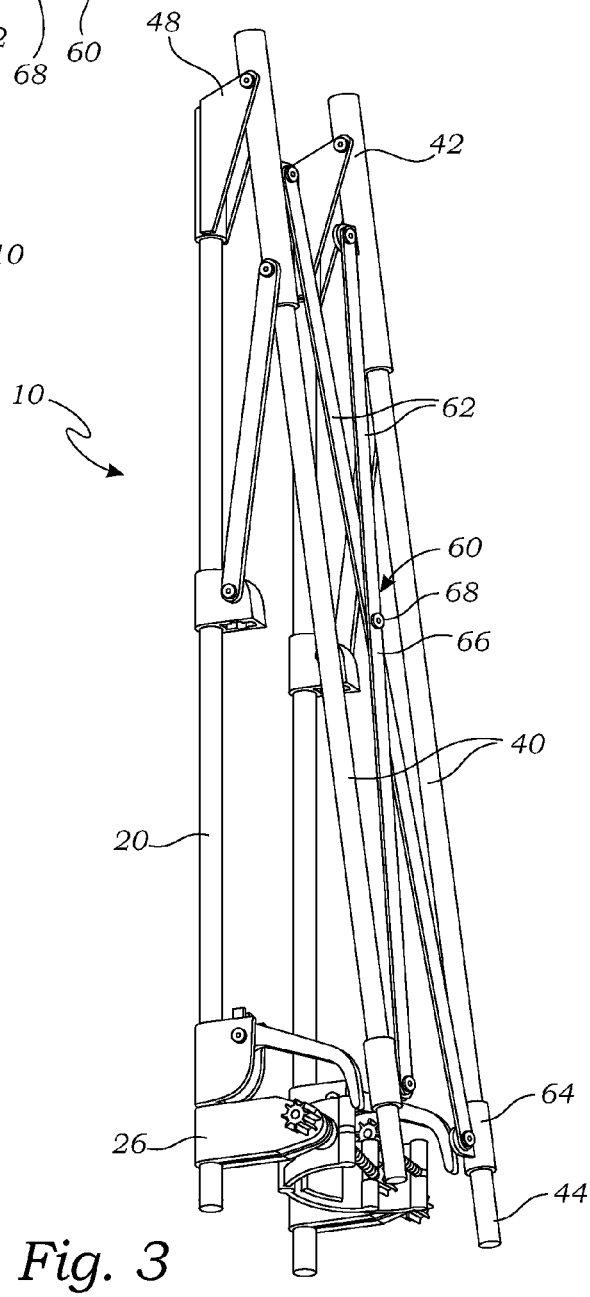
FIG. 3 is a perspective view of the sunshade apparatus of FIG. 2 once the sunshade apparatus has been moved from the extended configuration to a folded configuration.

FIG. 1 is an exploded perspective view of a sunshade apparatus 10 according to one embodiment of the present invention, illustrating the sunshade apparatus 10 in an extended and spread configuration, and mounted on the chair 12. FIG. 2 is a perspective view of the sunshade apparatus 10 of FIG. 1 once the sunshade apparatus 10 has been moved from the spread configuration to a collapsed configuration. FIG. 3 is a perspective view of the sunshade apparatus 10 of FIG. 2 once the sunshade apparatus 10 has been moved from the extended configuration to a folded configuration.

As shown in FIGS. 1-3, the sunshade apparatus 10 includes a flexible canopy element 46 for shielding a user from the sun, and a support structure 18 for operably supporting the flexible canopy element 46 above the chair 12. The sunshade apparatus 10 also includes a pair of attachment elements 26. Each of the attachment elements 26 is adapted to be removably attached to the support structure 18 for mounting the flexible canopy element 46 above the chair 12.

In one embodiment, the support structure 18 includes a pair of vertical support legs 20 that are adapted to be attached to the chair 12, and a pair of horizontally extending arms 40 that extend horizontally for shading the chair 12. Each of the pair of vertical support legs 20 has a top end 22 and a bottom end 24. The pair of attachment elements 26 may be attached to the bottom ends 24 of the pair of vertical support legs 20 for mounting the sunshade apparatus 10 on the chair 12.

While FIG. 1 is one embodiment of the support structure 18, it may also include any number of alternative structures known in the art, or that can be developed by one skilled in the art, for shading the chair 12. In alternative embodiments, the support structure 18 may include any number of awnings, umbrellas, and other structures should be included within the scope of this terminology, as defined herein.

Figure 4:
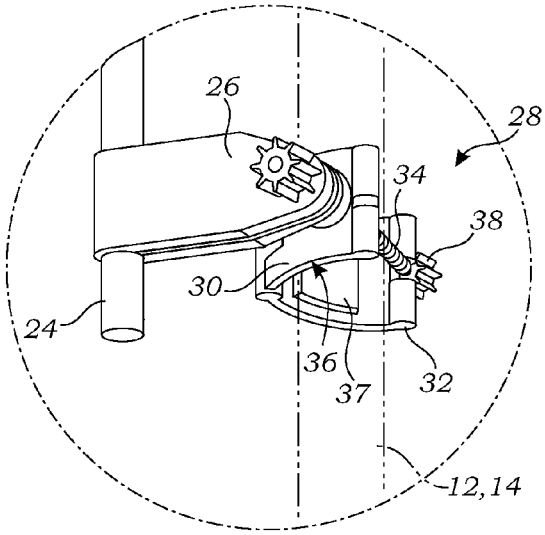
FIG. 4 is an enlarged view of an attachment element of the sunshade apparatus of FIG. 1, illustrating the attachment element in a closed position around a tubular element of the chair.
Figure 5:
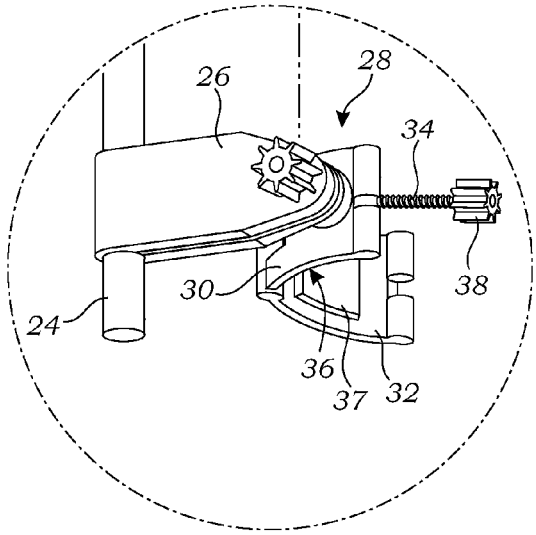
FIG. 5 is an enlarged view of an attachment element of the sunshade apparatus of FIG. 1, illustrating the attachment element in an open position.

FIG. 4 is an enlarged view of an attachment element 26 of the sunshade apparatus 10 of FIG. 1, illustrating the attachment element 26 in a closed position around a tubular element 14 of the chair 12. FIG. 5 is an enlarged view of an attachment element 26 of the sunshade apparatus 10 of FIG. 1, illustrating the attachment element 26 in an open position.

As shown in FIGS. 4 and 5, each of the pair of attachment elements 26 may also include a clamp 28 having a first locking portion 30 hingably attached to a second locking portion 32, and a locking screw 34 for clamping the first and second locking portions 30 and 32 around a tubular element 14 of the chair 12. The locking screw 34 may be hingably attached to the first locking portion 30 and pivots between a closed position wherein the locking screw 34 lockingly engages the second locking portion 32, and an open position wherein the locking screw 34 is disengaged from the second locking portion 32.

The first locking portion 30 and the second locking portion 32 each may include concave inner surfaces 36 and 37 adapted to clamp against the tubular element 14 of the chair 12. The locking screw 34 may include a knob 38 that enables a user to manually tighten each of the pair of attachment elements 26 so that the first locking portion 30 and the second locking portion 32 are tightly clamped around the tubular element 14.

While one embodiment of the attachment elements 26 is described and illustrated in detail, alternative embodiments of the attachment element 26 may also be used in alternative constructions. An alternative embodiment of the attachment elements 26 are also described below and illustrated in FIGS. 9 and 10.

As shown in FIGS. 1-3, the sunshade apparatus 10 may further include a pair of horizontally extending arms 40. Each of the pair of horizontally extending arms 40 may have a proximal end 42 and a distal end 44. The pair of horizontally extending arms 40 may be constructed of an elongate, rigid material, preferably tubular steel, aluminum, or similar material, and extend generally horizontally for the supporting the flexible canopy element 46 attached to the pair of horizontally extending arms 40. As shown in FIG. 1, the flexible canopy element 46 may extend between the pair of horizontally extending arms 40 when the pair of horizontally extending arms 40 are in the spread configuration, and functions to shade the chair 12. The flexible canopy element 46 has been removed from the pair of horizontally extending arms 40 in FIGS. 2 and 3, for more clearly illustrating the frame structure of the sunshade apparatus 10.

The pair of horizontally extending arms 40 may be attached to the pair of vertical support legs 20 with a pair of hinges 48. In this embodiment, each of the pair of hinges 48 hingably connects the top end 22 of one of the pair of vertical support legs 20 to the proximal end 42 of one of the pair of horizontally extending arms 40 such that the pair of horizontally extending arms 40 can pivot with respect to the pair of vertical support legs 20 between a folded configuration and an extended configuration.

Figure 6:
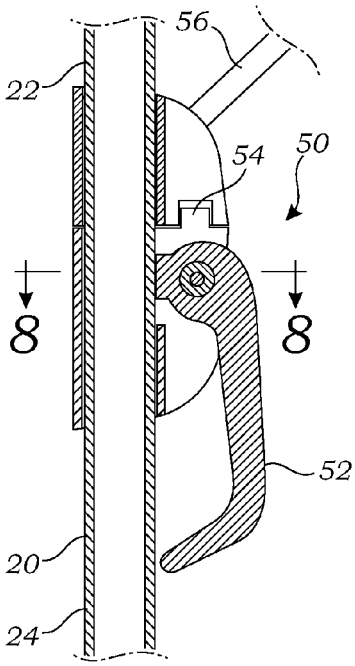
FIG. 6 is a sectional view thereof taken along line 6-6 in FIG. 1, illustrating a locking element having a locking handle, and wherein the locking handle is in a locked position.
Figure 7:
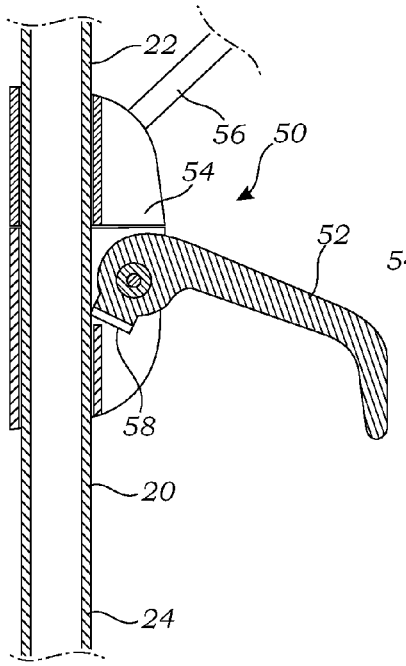
FIG. 7 is a sectional view of the locking element of FIG. 6, wherein the locking handle is in an unlocked position.
Figure 8:
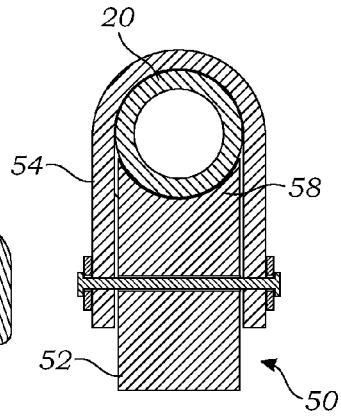
FIG. 8 is a sectional view of the locking element taken along line 8-8 in FIG. 6.

FIGS. 6-8 illustrate a locking element 50 of the sunshade apparatus 10. FIG. 6 is a sectional view of the sunshade apparatus 10 taken along line 6-6 in FIG. 1, illustrating a locking element 50 having a locking handle 52, and wherein the locking handle 52 is in a locked position. FIG. 7 is a sectional view of the locking element 50 of FIG. 6, wherein the locking handle 52 is in an unlocked position. FIG. 8 is a sectional view of the locking element 50 taken along line 8-8 in FIG. 6.

As shown in FIGS. 1, 2, and 6-8, the locking element 50 functions to lock the pair of horizontally extending arms 40 in the extended configuration (as shown in FIG. 2) with respect to the pair of vertical support legs 20. The locking element 50 may include a slider element 54 that is adapted to slidably engage one of the pair of vertical support legs 20. The slider element 54 is pivotally attached to a support bar 56, which is pivotally attached to one of the pair of horizontally extending arms 40, such that moving the slider element 54 towards the top end 22 of the one of the pair of vertical support legs 20 causes the support bar 56 to push the one of the pair of horizontally extending arms 40 from the folded configuration, as shown in FIG. 3, to the extended configuration, as shown in FIGS. 1 and 2.

As shown in FIGS. 6-8, the locking handle 52 is pivotally attached to the slider element 54 such that the locking handle 52 can pivot between a locked position, as shown in FIGS. 6 and 8, and an unlocked position, as shown in FIG. 7. The locking handle 52 may have a locking portion 58 that engages the one of the pair of vertical support legs 20 to lock the locking element 50 with respect to the one of the pair of vertical support legs 20. The locking portion 58 may frictionally engage the one of the pair of vertical support legs 20.

As shown in FIGS. 1 and 2, the sunshade apparatus 10 may further include a folding element 60 that joins the pair of horizontally extending arms 40. The folding element 60 enables the sunshade apparatus 10 to fold between a collapsed configuration, shown in FIGS. 2 and 3, wherein the pair of horizontally extending arms 40 are adjacent, and a spread configuration, shown in FIG. 1, wherein the pair of horizontally extending arms 40 are laterally spaced from each other.

The folding element 60 may include a pair of folding cross-bars 62 that are each pivotally attached at a first end to one of the pair of horizontally extending arms 40, and each pivotally attached at a second end to a horizontal slider 64 that is adapted to slidably engage one of the pair of horizontally extending arms 40. The pair of folding cross-bars 62 may be pivotally connected together in a middle 66 with a pivot pin 68.

While the illustrated embodiment of the folding element 60 illustrates one embodiment, alternative structures may also be devised by those skilled in the art, and should be considered within the scope of the present invention.

Figure 9:
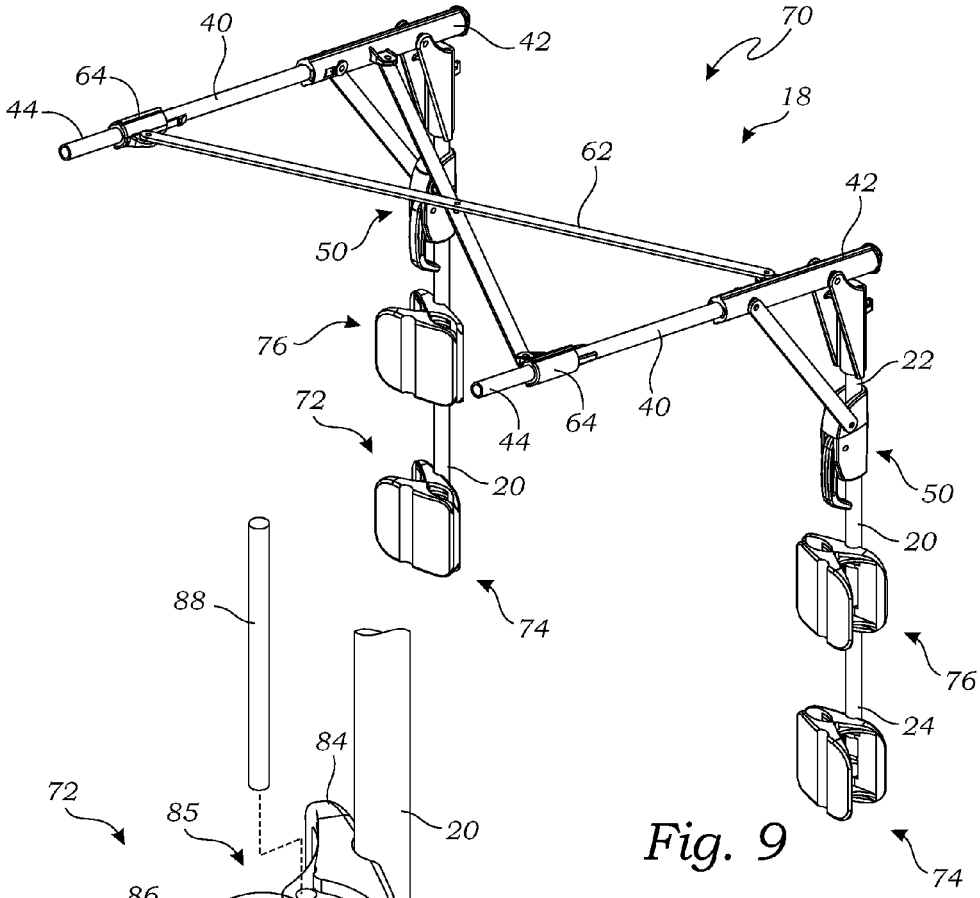
FIG. 9 is a perspective view of another embodiment of the sunshade apparatus, including an alternative embodiment of the attachment elements.

FIG. 9 is a perspective view of another embodiment of the sunshade apparatus 70, including an alternative embodiment of the attachment elements 72. As illustrated in FIG. 9, the alternative embodiment of the sunshade apparatus 70 may include a bottom pair of attachment elements 74 that may be attached to the bottom ends 24 of the pair of vertical support legs 20. The attachment elements 72 may also include a top pair of attachment elements 76 attached to the pair of vertical support legs 20 above the bottom pair of attachment elements 74.

The top and bottom pairs of attachment elements 74 and 76 are adapted for mounting the support structure 18 to the chair 12 (illustrated in FIG. 1) such that the flexible canopy element 46 (also illustrated in FIG. 1) is positioned above the chair. The top pair of attachment elements 76 may be positioned above and vertically spaced from the bottom pair of attachment elements 74 to increase the strength of the connection to the chair, without requiring the attachment elements 72 to be especially strong, complex, or difficult to use. To the contrary, the attachment elements 72 are extremely simple and easy to attach, yet the combination of top and bottom pairs makes the connection especially strong.

Figure 10:
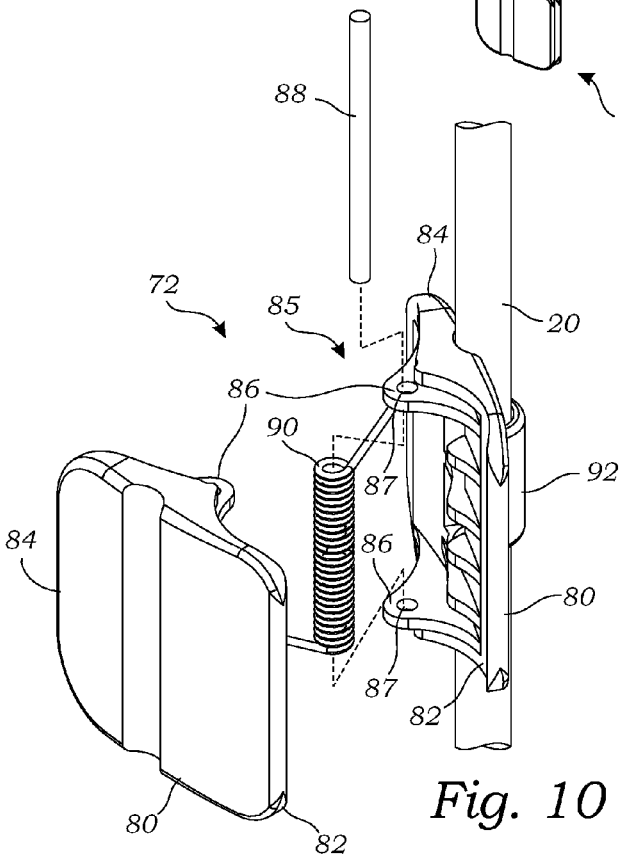
FIG. 10 is an exploded perspective view of the alternative embodiment of the attachment elements.

FIG. 10 is an exploded perspective view of the alternative embodiment of one of the attachment elements 72 utilized in each of the top and bottom attachment elements 74 and 76. As illustrated in FIG. 10, each of the attachment elements 72 includes a pair of clamp elements 80 that each include a clamping end 82 opposite a lever end 84. The clamping ends 82 are shaped to clamp around the chair 12 (illustrated in FIG. 1). A hinge 85 connects the pair of clamp elements 80 such that the clamp elements 80 may pivot between an open position wherein the clamping ends 82 are spread apart for receiving the chair 12, and a closed position wherein the clamping ends 82 are closed against the chair 12.

In one embodiment, the hinge 85 includes flanges 86 each with an aperture 87, and a rod 88 that fits through the apertures 87 to form the hinge 85. Obviously, those skilled in the art may develop a wide variety of hinges, all of which should be considered within the scope of the present invention.

A spring 90 biases the clamping ends 82 of the clamp elements 80 towards the closed position. In one embodiment, the spring 90 may be a torsion spring, although other types of springs may be utilized, and the term spring is hereby broadly defined to include any resilient member that functions to provide the required bias, or any equivalent mechanism or element.

The lever ends 84 extend outwardly from the clamp elements 82 such that they may be squeezed together to overcome the bias of the spring 90 and move the clamp elements 82 towards the open position, thereby enabling the clamp elements 82 to be removed from the chair 12 (shown in FIG. 1).

Each of the clamp elements 82 is adapted to be attached to one of the vertical support legs 20, or another suitable location on the support structure. In one embodiment, the clamp element 82 includes a receiver 92 shaped to receive the vertical support leg 20 therethrough. In the illustrated embodiment, the receiver 92 is cylindrical; however, in alternative embodiments it may have other shapes or forms. Various other pins, fasteners, or other structures may be used to form the connection, and such alternatives are considered within the scope of the present invention.

While the bottom pair of attachment elements 74 include a stop or boot (not shown) that prevents vertical movement of the attachment elements 74, the top pair of attachment elements 76 do not require such restriction, and may be freely adjustable.

The unique attachment elements 72 of the present invention enables the sunshade apparatus 10 to be attached at any position on the chair 12, regardless of the construction of the chair 12, the shape of the frame, or other factors. Furthermore, this also allows the height of the sunshade apparatus 10 to be readily adjusted relative to the chair 12.

Certain terminology is used in the preceding description for convenience only, and is not limiting. Words such as "vertical," "horizontal," "first," "second," "inner," "outer," "upper," "lower," "top," "bottom," and the like, designate directions in the drawings to which reference is made, and do not constrain the scope of the claimed invention. Furthermore, terms like "vertical" and "horizontal" do not require specific geometric parameters, but merely refer to the general orientation of these elements in typical use, and should not impute any additional requirements to the claimed invention.

The terminology used in the preceding description includes not only the specific words used and described above, but also similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one embodiment, it is to be clearly understood by those skilled in the art that the invention is not limited thereto. Rather, the scope of the invention is to be interpreted only in conjunction with the appended claims.

What is claimed is:

1. A sunshade apparatus for shading a chair, the sunshade apparatus comprising:

a flexible canopy element;

a support structure for supporting the flexible canopy element above the chair, the support structure including a pair of vertical support legs each having a top end and a bottom end, and a pair of horizontally extending arms, each of the pair of horizontally extending arms being attached to the top end of one of the pair of vertical support legs, the pair of horizontally extending arms functioning to support the flexible canopy element;

a folding element that joins the pair of horizontally extending arms and enables the sunshade apparatus to fold between a collapsed configuration, wherein the pair of horizontally extending arms are adjacent, and a spread configuration, wherein the pair of horizontally extending arms are laterally spaced from each other;

a bottom pair of attachment elements attached to the bottom ends of the pair of vertical support legs;

a top pair of attachment elements attached to the pair of vertical support legs above and vertically spaced from the bottom pair of attachment elements;

wherein the top and bottom pairs of attachment elements are adapted for mounting the support structure to the chair such that the flexible canopy element is positioned above the chair, and wherein each of the top and bottom attachment elements includes:

a pair of clamp elements that each include a clamping end opposite a lever end, the clamping ends of the pair of clamp elements together being shaped to clamp around the chair;

a hinge connecting the pair of clamp elements such that the pair of clamp elements may pivot between an open position wherein the clamping ends are spread apart for receiving the chair, and a closed position wherein the clamping ends are closed against the chair;

a spring for biasing the clamping ends of the clamp elements towards the closed position; and wherein the lever ends extend outwardly from the clamp elements such that they may be squeezed together to overcome the bias of the spring and move the clamp elements towards the open position thereby enabling the clamp elements to be removed from the chair.

* * * * *